US006117627A

United States Patent [19]

Tanaka et al.

[11] Patent Number: 6,117,627

[45] Date of Patent: Sep. 12, 2000

[54] SILVER HALIDE LIGHT SENSITIVE PHOTOGRAPHIC MATERIAL

[75] Inventors: Shinri Tanaka; Taketoshi Yamada, both of Hino, Japan

[73] Assignee: Konica Corporation, Tokyo, Japan

[21] Appl. No.: 09/243,442

[22] Filed: Feb. 3, 1999

[30] Foreign Application Priority Data

Feb. 6, 1998 [JP] Japan ..... 10-041290

[51] Int. Cl.[7] ..... G03C 1/76; G03C 1/825

[52] U.S. Cl. ..... 430/511; 430/7; 430/138

[58] Field of Search ..... 430/7, 511, 138

[56] References Cited

U.S. PATENT DOCUMENTS 5,352,559 10/1994 Tsujimoto et al. ..... 430/138

FOREIGN PATENT DOCUMENTS 1811983 6/1970 Germany .

137502 1/1920 United Kingdom .

326780 3/1930 United Kingdom .

05597 9/1992 United Kingdom .

OTHER PUBLICATIONS

E. Mutter, "Die Wissenschaftliche und angewandte Photographie, Vierter Band, Farbphotographie Theorie und Praxis", 1967, Springer–Verlag, Wien, pp. 38–43.

R.W.G. Hunt, "The Reproduction of Colour", 1995, Fountain Press, Kingston–Upon–Thames XP002109511.

European Search Report Jan. 26, 2000.

*Primary Examiner*—Janet Baxter

*Assistant Examiner*—Amanda C. Walke

*Attorney, Agent, or Firm*—Finnegan, Henderson, Farabow, Garrett & Dunner, L.L.P.

[57] ABSTRACT

A silver halide light sensitive photographic material is disclosed, comprising a transparent support having thereon a silver halide emulsion layer, and the photographic material further having a color filter layer comprising picture elements comprised of a colored resin and randomly arranged.

9 Claims, No Drawings

SILVER HALIDE LIGHT SENSITIVE PHOTOGRAPHIC MATERIAL

FIELD OF THE INVENTION

The present invention relates to a silver halide light sensitive photographic material with a color filter, and in particular to a color filter which can be provided at a low cost, a photographic material containing the filter, a method for exposing and processing the photographic material and an image forming method by the use thereof.

BACKGROUND OF THE INVENTION

Color filters have been employed not only in CCD or liquid crystal displays but also in preparation of a color slide in combination with a silver halide light sensitive photographic material (hereinafter, also simply referred to as a light sensitive material, or photographic material). These color filters, in which cells are regularly arranged, meet the requirements of a color filter used for a CCD or liquid crystal display. However, they have problems such that preparation thereof includes many complex processes and requirements, resulting in high costs.

The use of the color filter in combination with a photographic material has been known in the art, such as a photographic material used for preparing a color slide available from Polaroid Corp. (Instant Slide). In this sort of use, the color filter having the same area as the photographic material is needed and its cost of production is strongly demanded to be as low as possible. However, a color filter at a low cost is not available and its development has been strongly desired.

With the recent rapid spread of personal computers and popularization of the internet, there have been increased opportunities of inputting image information on personal computers to process it for utilization. To input the image information into the personal computer, there is available a method of taking pictures with a digital camera or a method of inputting the image information of conventional color photographic material with a scanner. The former has problems that the number of using picture elements is small, leading to a narrow latitude and insufficient contrast. The latter needs to subject the color photographic material to photographic processing at a photo shop and requires complex color processing, having problems such that it takes time to obtain the image information. There has been desired a color photographic material which is processable in a more simplified manner and can be read by a scanner, but no color photographic material meeting such demands has been known.

A method of obtaining color images by combining a color filter with a monochromatic photographic material (Instant Slide) was proposed by Polaroid Corp. The color filter used, in which picture elements are regularly arranged, has the problems that the cost is high and interference fringes are sometimes produced.

When used in combination with a silver halide photographic material, preferably employed as a support of the color filter is triacetyl cellulose, polyethylene terephthalate or polyethylene naphthalate. However, there has not been known a color filter having such a support and also meeting the above requirements.

Recently, public concern about environment protection has increased, and reduction of hazardous waste material and effective utilization of limited resources is desired. In the photographic material is used silver halide as an image recording medium, employing precious silver resources. Silver is a limited noble metal resources and effective utilization thereof has been desired. Silver is one of the heavy metals and its effluent standard is so severe that the complete recovery of silver is desired from the viewpoint of environment. In addition, the common silver resources recovering method conducted at the present time is that photographic waste liquor or its concentrated solution is transported to a recovery plant for the recovery od silver. There are several shortcomings in terms of energy saving and cost reduction such as: energy is required for concentrating the photographic waste liquor, expensive equioments are necessary for concentration, and the transportation of the photographic waste liquor is inefficient due to transporting it together with non-valuable water having a weight of several hundred times that of contained silver. Further, the energy load to completely recover silver dissolved in the solution is also large. In view of the foregoing, a method is demanded to readily recover silver resources contained in the photographic material without allowing the silver to be leached out of the photographic material.

A complex-forming compound such as EDTA or PDTA used in photographic processing is not easily decomposed by bacteria, increasing the load on the effluent treatment, where the stoping of the use thereof is desired.

Thus, a photographic material, an image forming method and a processing method of the photographic material by which high quality images can be easily obtained at a low cost and which is friendly to the environment, and a resources recovering method were desired, but the prior art could not satisfy all of these requirements.

Providing a color filter increases the thickness of the photographic material. An increase of the thickness of the photographic material generally increases light scattering, disadvantageously leading to deterioration of image quality such as sharpness. Accordingly, a method without producing deterioration of the image quality is desired. It is common knowledge to one skilled in the art that a conventional photographic material has a silver halide emulsion layer on the support and is exposed to light from the emulsion side.

SUMMARY OF THE INVENTION

An object of the present invention is to provide a low-priced color filter and a silver halide color photographic material with the filter.

A second object of the present invention is to provide a silver halide color photographic material, an image forming method and a processing method of the photographic material, whereby an image information can be stably obtained through simple processing.

A third object of the present invention is to provide a method for exposing the photographic material without any deterioration of the image quality.

A fourth object of the present invention is to provide a silver halide photographic material which is easy in resources recovery and contributes to environment protection, and a resources recovering method relating thereto.

The above objects of the present invention can be accomplished by the following constitution:

1. a silver halide light sensitive photographic material comprising a transparent support having thereon a silver halide emulsion layer, and the photographic material further having on the support a color filter layer comprising picture elements comprised of a randomly arranged colored resin;

2. the photographic material described above, wherein the color filter layer further comprises a water miscible binder;
3. the photographic material described in item 1 or 2, wherein the colored resin contains a metal complex compound, as a colorant;
4. the photographic material described in any of items 1 to 3, wherein the colored resin is colored in three primary colors;
5. the photographic material described in any of items 1 to 4, wherein the support is comprised of triacetyl cellulose, polyethylene terephthalate or polyethylene naphthalate;
6. the photographic material described in items 1 to 5, wherein the picture elements are formed of colored resin particles, the resin particles comprising an interior portion and an exterior portion which are different in glass transition temperature;
7. the photographic material described in any of items 1 to 6, comprising the transparent support having one side of the support the color filter layer and having on the other side of the support the silver halide emulsion layer;
8. the photographic material described in any of items 1 to 6, comprising the transparent support having one side of the support said color filter layer and the silver halide emulsion layer in this order from the support;
9. an image forming method, wherein, after exposing and developing the photographic material described in any of items 1 to 8, an image information obtained is further converted to an electric image information;
10. a method for processing the photographic material described in any of items 1 to 8, wherein after exposure, the photographic material is processed with a processing solution substantially permeable into the photographic material; and
11. a method for exposing the photographic material described in any of items 1 to 8, wherein the the photographic material is exposed to light from the other side of the support opposite the emulsion layer side.

DETAILED DESCRIPTION OF THE INVENTION

In the present invention, the color filter refers to an optical filter which is colored in different tints and has two or more spectral absorption regions. The color filter according to this invention is preferably colored in three primary colors. The three primary colors may be red, green and blue of additive primaries or yellow, magenta and cyan of subtractive primaries. Therefore, in a preferred embodiment of the invention, the colored resin used in the filter is comprised of a red-colored, green-colored or blue-colored resin, or comprised of a yellow-colored, magenta-colored or cyan-colored resin.

The expression "randomly arranged" means that two or more picture elements which are adjacent to each other, are not arranged in a regular manner. In other words, it means that when not less than 3 non-parallel straight lines are drawn on the surface of a color filter comprised of different colored resins of "n" colors ($n \geqq 2$), the arrangement order of "n" colors on any of the straight lines is not repeated. In this case, one color resin corresponds to one picture element, and the color resin particles are not always uniform with respect to size or form.

The water miscible binder refers to a substance which is miscible with water and capable of forming a film upon drying. Exemplary examples thereof include gelatin, polyvinyl alcohol and polyvinyl pyrrolidone. Of these, gelatin is preferably employed in terms of its low cost and excellence in film forming capability. A variety of gelatins known in the art can be employed.

In this invention, the metal complex is referred to as a complex comprised of a metal and an organic ligand. The metal is not specifically limited, so long as the metal has coordination capability. Examples thereof include transition metals, of which Ni, Co, Cu and Cr are preferred. The organic ligand is not specifically limited, but a bidentate ligand or a tridentate ligand are preferred. Examples of the organic ligand include colorants such as azomethines, methines and oxonols. Nickel complexes of these colorants are preferred in terms of absorption being sharp and image stability being superior.

In this invention, the colored resin preferably has a glass transition temperature (Tg) of not less than 40° C. and not more than 100° C., however, the Tg is preferably not less than 70° C., in terms of ease of thermal fixing treatment. It is preferred that the picture elements are formed of colored resin particles having different glass transition temperatures between the interior portion and the exterior portion. Specifically, when the Tg in the external portion is higher than that in the internal portion, mixing of the resin with each other during thermal fixing is reduced. The heating means during thermal fixing is not specifically limited, but examples thereof include heating with a heated roller and electromagnetic heating and of these is preferred heating with a heated roller. The heating time is also not specifically limited, but is preferably from 10 msec. to 10 sec, and more preferably from 10 msec. to 1 sec. When subjected to such thermal fixing, it is preferred that pressure treatment be concurrently conducted, with the pressure preferably being 1 to 100 $kg/cm^2$, and more preferably 2 to 10 $kg/m^2$.

The three primary colors may be red, green and blue of the additive primaries or yellow, magenta and cyan of the subtractive primaries.

Supports used in this invention are not specifically limited. Exemplary examples thereof include triacetyl cellulose (TAC), polyethylene terephthalate (PET), polyethylene naphthalate (PEN), other polyesters, polyethylene-coated paper, and celluloid. Of these, TAC, PET and Pen are preferred in terms of strength, workability and transparency, and more preferable is TAC.

Picture elements of the color filter according to the invention are randomly arranged. The amount of the picture elements corresponding to each of the primary colors is not necessarily the same for each color and can optionally be adjusted. A larger amount of the picture elements corresponding to green light is preferably used, leading to recording density meeting the luminosity factor. It is also possible to constitute three primary colors by the use of two kinds of resins colored with two primary colors and a binder colored with the other primary color. The use of the colored binder is preferred in terms of overcoming defects of the color filter due to overlapping of the colored resin.

Exposure of the silver halide photographic material according to the invention is not specifically limited, and contrary to the convention color photographic materials, the photographic material according to the invention is preferably exposed to light from the side opposite the light sensitive silver halide emulsion layer, in terms of reduced deterioration of image quality.

Development of the photographic material is also not specifically limited and any one of the heat development and liquid development is feasible. As for the liquid development, spray development (in which a developing solution is sprayed onto the photographic material, in an amount which is substantially permeable into the photographic amount) and coating development (in which a developing solution is coated on the photographic material, in an amount which is substantially permeable into the photographic amount) are also feasible.

In the image forming process relating to the present invention, a scanner is preferably employed to convert a visual image information into an electric image information.

It is preferable in terms of effective employment of resources and environment protection that after exposing and processing the photographic material according to the invention, an image information obtained from the processed photographic material be converted to an electric image information and then the silver halide photographic material be subjected to resources recovery without being given to a user.

The present invention is furthermore explained. The silver halide color photographic material used in this invention is not specifically limited with respect to the kind, including a color negative film, color reversal film and a direct positive photographic material. The color photographic material preferably has a red-sensitive silver halide emulsion layer, a green-sensitive silver halide emulsion layer and a blue-sensitive silver halide emulsion layer to record red, green and blue light. The speed of the silver halide color photographic material is preferably ISO 30 or more, more preferably ISO 100 or more, and still more preferably ISO 400 or more.

With regard to the method, system and conditions of processing usable in the invention, known methods and systems are applicable. Exemplarily, the processing conditions of the C-41 Process, which is the standard processing condition for a color negative film for general use, is preferably applied. It is preferable to complete processing without bleaching and fixing, in terms of shortening of the processing time, recovery of silver resources and easy disposal of processing effluent. Development in which a developing solution in an amount which is substantially permeable into the photographic: material is sprayed onto the photographic material (such as in ink-jet development) or is coated on the photographic material, is also feasible. Any common developing solution-spraying method of any kind is applicable, including spraying with moving a single movable nozzle or spraying by use of plural fixed nozzles. Spraying may be carried out by fixing the photographic material and moving the nozzle, or by fixing the nozzle and moving the photographic material. In cases where developing by supplying a developing solution in an amount which is substantially permeable into the photographic material through a medium holding the developing solution to the photographic material, the medium holding the developing solution is not specifically limited and felt, fabrics and a metal sheets having slits or holes are preferably used. A method of coating a developing solution on the photographic material through a medium while spraying the developing solution onto the photographic material or the medium is a;so applicable.

The scanner used in this invention is referred to as an apparatus in which the photographic material is optically scanned and an image information based on the transmission or reflection density is converted to an electric image information. It is conventional to scan necessary portions of the photographic material by moving the optical portion of a scanner in a direction different from the motion of the photographic material. Alternatively, it may be to move the optical portion of the scanner while fixing the photographic material, or to move the photographic material while fixing the optical portion of the scanner. Furthermore, a combination of these is also feasible. The light source to read-in the image information is not specifically limited, including a tungsten lamp, a fluorescent lamp, a light emitting diodes and lasers. Of these, the tungsten lamp is preferred in terms of low price and the laser (being a coherent light source) is preferred in terms of stability, high luminance and not being easily affected by scattering. The reading method is not specifically limited, but it is preferable to read transmission light in terms of sharpness.

The blue-sensitive silver halide emulsion layer, green-sensitive silver halide emulsion layer and red-sensitive silver halide emulsion layer described above refer to emulsion layers spectrally sensitized to blue light, green light and red light, respectively. Couplers contained in these layer are not specifically limited and coupler known in the art can be used.

Application of the thermal development in the invention is preferred in terms of shortening of the processing time and environment suitability. To allow a developing agent or its precursor to be incorporated in the silver halide photographic material is preferred in terms of making it easy to control a developing solution.

Compounds usable in this invention are described in known literature and by reference thereto, the compounds can readily be synthesized. Examples of the literature include JP-A Nos. 8-16644, 8-202002, 8-286340, 8-292531, 8-227131, 8-292529, 8-234388, 8-234390, 9-34081, 9-76570, 9-114062, 9-152686, 9-152691, 9-152692, 9-152693, 9-152703, 9-150794 and 9-150795 (herein, the term, JP-A means a unexamined and published Japanese Patent Application).

Exemplary examples thereof will be further explained. A silver halide emulsion usable in this invention is not specifically limited and silver halide emulsions known in the art can be used. There is no specific limitation with respect to the grain size, aspect ratio, halide composition (i.e., kind and content of the halide of silver halide), halide distribution (i.e., halide distribution within the grain) and the presence of dislocation lines of silver halide emulsion grains. The silver halide grain size (which is equivalent to an edge length of the cube having the same volume as the grain) is preferably 0.05 to 2 $\mu$m. The aspect ratio is preferably 4 or more in terms of sharpness, more preferably 8 or more , and still more preferably 12 or more. With regard to the halide composition, main component is preferably bromide and the bromide content is preferably 80 to 99 mol %, based on total silver halide, the iodide content being preferably 1 to 20 mol %. The presence of the dislocation lines is preferred in terms of sensitivity.

In the photographic material according to the invention, a silver halide emulsion is generally used, which has been subjected to physical ripening, chemical ripening and spectral sensitization. Additives used in these processes are described in Research Disclosure Nos. 17643, 18716 and 308119 (hereinafter, denoted as RD 17643, RD 18716 and RD 308119).

Relevant passages are shown below.

| Item | RD-308,119 | RD-17,643 | RD-18,716 |
|---|---|---|---|
| Chemical Sensitizer | 996, III-A | 23 | 648 |
| Spectral Sensitizer | 996, IV-A, B, C, D, H, I, J | 23–24 | 648–9 |
| Super Sensitizer | 996, IV-A–E, J | 23–24 | 648–9 |
| Anti-Foggant | 998, VI | 24–25 | 649 |
| Stabilizer | 998, VI | 24–25 | 649 |

Chemical sensitization of the emulsion used in this invention employs, singly or in combination, sulfur sensitization using a compound containing sulfur reactive with a silver ion, selenium sensitization with a selenium compound, reduction sensitization with a reducing substance and noble metal sensitization with gold or other noble metal compounds.

Chemical sensitizers include, for example, calcogen sensitizers, and particularly, sulfur sensitizer and a selenium sensitizer are preferable. Examples of the sulfur sensitizer include thiosulfates, allylthiocarbamates, thioureas, allylisothiocyanate, cystine, p-toluenethiosulfonates and a rhodanine. Furthermore, there are also usable sulfur sensitizers described in U.S. Pat. Nos. 1,574,944, 2,41,689, 2,278,947, 2,728,668, 3,501,313 and 3,656,955; West German patent (OLS) No. 1,422,869; and JP-A No. 56-24937 and 55-45016. The addition amount of the sulfur sensitizer is variable, depending on conditions such as the pH, temperature and silver halide grain size, and in general, $10^{-7}$ to $10^{-1}$ mol per mol of silver halide is preferred.

Examples of the selenium sensitizer include aliphatic isoselenocyanates such as allylisocyanate, selenoureas and selenides such as selenoselenides and diethylselenide. Exemplary examples thereof are further described in U.S. Pat. Nos. 1,574,944, 1,602,592 and 1,623,499. Furthermore, a reduction sensitizer can be used in combination.

Examples of the reduction sensitizer include stannous chloride, thiourea dioxide, hydrazines and polyamines. A compound of a noble metal other than gold can also be used in combination.

The silver halide emulsion used in this invention is preferably chemically sensitized with a gold compound. The gold compound preferably used in this invention includes various compounds containing gold having an oxidation number of +1 or +3. Examples thereof include potassium chloroaurate, auric trichloride, potassium auric thiocyanate, potassium iodoaurate, tetracyanoauric azide, ammonium aurothiocyanate, pyridyl trichlorogold, gold sulfide and gold selenide. The addition amount of the gold compound is generally $10^{-8}$ to $10^{-1}$ mol per mol of silver halide, and preferably $10^{-7}$ to $10^{-2}$ mol per mol of silver halide.

These compounds can be added at a time during the stage of grain formation, physical ripening, chemical sensitization or after completing the chemical sensitization.

Known photographic adjuvants usable in this invention are disclosed in the Research Disclosure described above. Relevant portions are shown below.

| Item | RD-308,119 | RD-17,643 | RD-18,716 |
|---|---|---|---|
| Anti-staining Agent | 1002, VII-I | 25 | 650 |
| Dye Image-Stabilizer | 1001, VII-J | 25 | |

-continued

| Item | RD-308,119 | RD-17,643 | RD-18,716 |
|---|---|---|---|
| Whitening Agent | 998, V | 24 | |
| U.V. Absorbent | 1003, VIII-C, XIII-C | 25–26 | |
| Light Absorbent | 1003, VIII | | |
| Binder | 1003, IX | 26 | 651 |
| Anti-Static Agent | 1006, XIII | 27 | 650 |
| Hardener | 1004, X | 26 | 651 |
| Plasticizer | 1006, XII | 27 | 650 |
| Lubricating Agent | 1006, XII | 27 | 650 |
| Surfactant; Coating aid | 1005, XI | 26–27 | 650 |
| Matting Agent | 1007, XVI | | |
| Developing Agent | 1011, XXB | | |

To prevent deterioration of photographic performance due to formaldehyde gas, a compound described in U.S. Pat. Nos. 4,411,987 and 4,435,503, which is capable of fixing upon reaction with formaldehyde, is preferably incorporated into the photographic material.

A variety of dye forming couplers can be used in this invention, and exemplary examples thereof are described in Research Disclosure (RD) NO. 17643, VII-C to G. Preferred couplers include those described in U.S. Pat. Nos. 3,933,051, 4,022,620, 4,326,024, and 4,401,752, 4,248,961; JP-B No. 58-10739 (herein, the term JP-B means a examined and published Japanese Patent); British Patent 1,425,020 and 1,476,760; U.S. Pat. Nos. 3,973,968, 4,314,023, and 4,511,649; and European Patent No. 279,473A. Preferred examples of 5-pyrazolone type and pyrazoloazole type compounds include those described in U.S. Pat. Nos. 4,310,619, 4,351,897, 3,061,432 and 3,725,067; European Patent 73,636; Research Disclosure No. 24230 (June, 1984); JP-A 60-43659, 61-72238, 60-35730, 55-118034 and 60-185951; U.S. Pat. Nos. 4,500,630, 4,540,654 and 4,556,630; and International Patent W088/04795. Preferred Examples of phenol type and naphthol type couplers include those described in U.S. Pat. Nos. 4,052,212, 4,146,396, 4,228,233, 4,296,200, 2,369,200, 2,369,929, 2,801,171, 2,772,162, 2,895,826, 2,772,002, 3,758,308; 4,334,011, 4,327,173; West German Patent No. 3,329,011; European Patent No. 121,365A and 249,453A; U.S. Pat. Nos. 3,446,622, 4,333,999, 4,775,616, 4,451,559, 4,427,767 4,690,889, 4,254,212, 4,296,199; and JP-A No. 61-42658.

Colored couplers to correct unwanted absorption can be used within the range of the spectral transmittance relating to this invention. Preferred examples thereof include those described in Research Disclosure No. 17643 VII-G; U.S. Pat. No. 4,163,670; JP-B 57-39413; U.S. Pat. No. 4,004,929, 4,138,258; and British Patent 1,146,368. Moreover, a coupler, capable of releasing a fluorescent dye which corrects unwanted absorption of a formed dye, as described in U.S. Pat. No. 4,774,181; and a coupler containing, as a leaving group, a dye precursor group capable of forming a dye upon reaction with an oxidation product, as described in U.S. Pat. No. 4,777,120.

Exemplary examples of a polymerized dye forming coupler are described in U.S. Pat. Nos. 3,451,820, 4,080,211, 4,367,282, 4,409,320, 4,576,910; and British Patent No. 2,102,173. A coupler capable of releasing a photographically useful group upon coupling reaction is also preferably used in this invention. Preferred examples of a DIR coupler releasing a developing inhibitor is described in above described RD 17643 VII-F, JP-A 57-151944, 57-154234, 60-184248, 63-37346; U.S. Pat. Nos. 4,248,962 and 4,782,012. Preferred examples of a coupler capable of imagewise releasing a nucleating agent or a development accelerating agent are described in British Patent 2,079,140 and 2,131,188; JP-A No. 59-157638 and 59-170840.

Furthermore, examples of couplers usable in this invention include a competing coupler described in U.S. Pat. No. 4,130,427; a poly-equivalent coupler described in U.S. Pat. Nos. 4,283,427, 4,338,393 and 4,310,618; a DIR redox compound releasing coupler described in JP-A No. 60-185950 and 62-24252; a DIR coupler releasing redox compound or DIR redox compound releasing redox compound; a coupler releasing a dye which is cured after being released, described in European Patent 173302A; bleach-accelerating agent releasing coupler described in RD 11440 and 24241 and JP-A 61-201247; a ligand releasing coupler described in U.S. Pat. No. 4,553,477; a leuco dye releasing coupler described in JP-A 63-75747; and a fluorescent dye releasing coupler described in U.S. Pat. No. 4,774,181.

A variety of couplers can be used in this invention, and exemplary examples are described in the RD described below. Relevant portions are shown below.

| Item | RD 308119 | RD17643 |
|---|---|---|
| Yellow Coupler | 1001, VII-D | 25, VII-C–G |
| Magenta Coupler | 1001, VII-D | 25, VII-C–G |
| Cyan Coupler | 1001, VII-D | 25, VII-C–G |
| Colored Coupler | 1002, VII-G | 25, VII-G |
| DIR Coupler | 1001, VII-F | 25, VII-F |
| BAR Coupler | 1002, VII-F | |
| PUG Releasing Coupler | 1001, VII-F | |

Adjuvants used in this invention can be incorporated through a dispersion method described in RD 308119 XIV.

EXAMPLES

The present invention will be further explained based on examples. In the following examples, the term "part(s)" means part(s) by weight, unless otherwise noted.

Example 1

Preparation of Color Filter

Preparation of colored resin Y:

To 100 parts of a polyester resin were added 3 parts of polypropylene and 4 parts of dye and the mixture was blended, kneaded, pulverized and classified to obtain powdery particles having an average size of 2.0 μm. Then this powder of 100 parts and silica fine particles (particle size of 12 nm, hydrophobicity degree of 60) of 1 part were mixed with a Henschell mixer to obtain colored resin Y.

Preparation of colored resin M:

Colored resin M was prepared in a manner similar to resin Y, provided that in place of dye Y, dye M was employed.

Preparation of colored resin C:

Colored resin C was prepared in a manner similar to the resin Y, provided that in place of dye Y, dye C was employed.

Preparation of dispersing solution 1:

To 10 g of each of the colored resin Y, colored resin M and colored resin C were added gelatin of 30 g, water of 100 ml and a surfactant of 0.5 g. The mixture was blended and dispersed with an ultrasonic homogenizer while being maintained at 50° C., and dispersion 1 was thus obtained. The dispersion 1 was added with a 0.1% hardener aqueous solution of 10 ml immediately before coating. The dispersion was coated on a triacetyl cellulose support of 50 μm by the use of an applicator having a slit of 50 μm and dried to obtain sample 101. Sample 101 was heated for 1 sec. while applying pressure of 4 kg/cm$^2$ by a roller heated to 120° C. to obtain Sample 102. Sample 102 was a color filter, in which yellow, magenta and cyan (alternatively, YMC) picture elements with a size of 3 to 4 μm were randomly arranged and no moire pattern was observed from any angle. It was proved that according to the manner as described above, a color filter with preferred property could be prepared simply and at a low cost.

Comparative Example 1

Ten grams of each of colored resins Y, M and C used in Example 1 were mixed and coated on a triacetyl cellulose support by the use of an applicator having a slit of 50 μm to obtain comparative Sample 11. Sample 11 was heated for 1 sec. while applying pressure of 4 kg/cm$^2$ by a roller heated to 120° C. to obtain comparative Sample 12. In preparation of Sample 11, the colored resin was easily scattered and the area near the coating machine was stained. It was proved that Sample 12, which had obvious overlapping of picture elements, was not preferable as a color filter. It was further proved that a satisfactory color filter could not be prepared in a manner similar to a dry working color copier using a color toner, and in addition, the working property was unacceptable.

Example 2

Preparation of Color Filter

Sample 201 was prepared in the same manner as in Example 1, except that in place of the use of the colored resin Y, yellow dye 2 was added to the gelatin binder used in Example 1. Sample 201 was heated for 1 sec. while applying pressure of 4 kg/cm$^2$ by a roller heated to 120° C. to obtain Sample 202. Sample 202 was a color filter, in which magenta and cyan picture elements with a size of 3 to 4 μm were randomly arranged on the yellow background. It was proved that Sample 202 had less overlapping of colored resins, and rather fewer defects and was more preferable as a color filter than Sample 102. Thus, it was shown that according to the manner of example 2, a color filter with superior property could be prepared simply and at a low cost.

Example 3

Preparation of Photographic Material

Using Sample 102 prepared in Example 1 as a support and on the side the color filter layer, a coating solution 301 was coated and dried to obtain Sample 301.

Preparation of coating solution 301

[Preparation of silver halide emulsion]

Preparation of seed emulsion-1

Seed emulsion-1 was prepared in the following manner. To solution A1, as shown below, maintained at 35° C. with stirring by a mixer described in JP-B No. 58-58288 and 58-58289 were added a silver nitrate aqueous solution (1.161 mol) and an aqueous solution of potassium bromide and potassium iodide (potassium iodide of 2 mol %) by the double jet addition over a period of 2 min., while maintaining a silver potential at 0 mV (measured with a silver ion selection electrode using a reference electrode of saturated silver-silver chloride electrode), to form nucleus grains. Subsequently, the reaction mixture was raised to a temperature of 60° C. in 60 min. and after adjusting the pH to 5.0, a silver nitrate aqueous solution (5.902 mol) and an aqueous solution of potassium bromide and potassium iodide (potassium iodide of 2 mol %) were added by the double jet addition over a period of 42 min., while maintaining the silver potential at 9 mV. After completing the addition, the temperature was lowered to 40° C. and the emulsion was washed by the flocculation method to remove soluble salts.

The resulting seed emulsion was comprised of tabular grains having an average sphere equivalent diameter of 0.24 μm and an average aspect ratio of 4.8, in which at least 90% of the total grain projected area were accounted for by hexagonal tabular grains exhibiting the maximum edge ratio of 1.0 to 2.0. The emulsion was denoted as seed emulsion-1.

| Solution A1: | |
|---|---|
| Ossein gelatin | 24.2 g |
| Potassium bromide | 10.8 g |
| $HO(CH_2CH_2O)m[CH(CH_3)CH_2O)_{19.8}(CH_2CH_2O)nH$ (m + n = 9.77, 10% ethanol solution) | 6.78 ml |
| 10% nitric acid | 114 ml |
| $H_2O$ | 9657 ml |

Preparation of silver iodide fine grain emulsion SMC-1:

To 5 liters of a 6 wt. % gelatin aqueous solution containing potassium iodide of 0.06 mol, an aqueous solution containing 7.06 mol of silver nitrate and an aqueous solution containing 7.06 mol of potassium iodide, 2 liters of each were added over a period of 10 min., while the pH was maintained at 2.0 using nitric acid and the temperature was maintained at 40° C. After completion of grain formation, the pH was adjusted to 6.0 using a sodium carbonate aqueous solution. The resulting emulsion was comprised of fine silver iodide grains exhibiting an average size of 0.05 μm, and denoted as SMC-1.

Preparation of silver iodide emulsion d:

An aqueous 4.5 wt % gelatin solution of 700 ml containing the seed emulsion equivalent to 0.178 mol and 0.5 ml of a 10% ethanol solution of $HO(CH_2CH_2O)m[CH(CH_3)CH_2O)_{19.8}(CH_2CH_2O)nH$ (m+n=9.77) was maintained at 75° C., and after adjusting the pAg and pH to 8.4 and 5.0, respectively, grain formation was carried out by the double jet method with vigorously stirring, according to the following procedure.

1) An aqueous solution of 2.1 mol silver nitrate, SMC-1 of 0.195 mol and an aqueous potassium bromide solution were added while maintaining the pAg and pH at 8.4 and 5.0, respectively.
2) Subsequently, the reaction mixture solution was lowered to the temperature of 60° C. and the pH was adjusted to 9.8. Thereafter, SMC-1 of 0.071 mol was added thereto and ripening was carried further for 2 min. (to introduce dislocation lines).
3) An aqueous solution of 0.959 mol silver nitrate, SMC-1 of 0.03 mol and an aqueous potassium bromide solution were added, while maintaining the pAg and pH at 9.8 and 5.0, respectively.

During the grain formation, each solution was added at an appropriate flow rate so as to prohibit occurrence of nucleus grain formation or Ostwald ripening among grains. After completing the addition, the emulsion was washed by the flocculation process at 40° C., to which gelatin was added and redispersed, and the pAg and pH were adjusted to 8.1 and 5.8, respectively. The resulting emulsion was comprised of tabular grains having an average grain size of 0.75 μm (edge length of a cube having a volume equivalent to the grain), an average aspect ratio of 5.0 and an iodide composition of 2/8.5/X/3 mol % in the order from the grain interior (X indicating the position of introducing the dislocation lines). From microscopic observation of the emulsion grains, it was proved that at least 60% of the total grain projected area was accounted for by grains having 5 or more dislocation lines in the fringe portions as well as in the interior. It was also proved that the surface iodide content was 6.7 mol %.

The above emulsion was divided into three parts, A, B and C. To emulsion A were added sensitizing dyes SD-1, SD-2, SD-3 and SD-4; to emulsion B were added SD-5, SD-6, SD-7, SD-8 and SD-9; and to emulsion C were added SD-10 and SD-11. Then, to each emulsion was further added triphenylphosphine selenide, sodium thiosulfate, chloroauric acid and potassium thiocyanate and subjected to chemical sensitization according to the conventional manner so as to achieve an appropriate relation between fog and sensitivity. Finally, the resulting emulsions were blended in a ratio so as to achieve a desired spectral sensitivity. The thus obtained emulsion was denoted as emulsion D. To the emulsion D (1.95 g), a gelatin dispersing solution containing coupler Y-1 (0.71 g), M-1(0.28 g) and C-1 (0.56 g), and tricresyl phosphate of 1.5 g was added to obtain a coating solution 301. The coating solution was coated to obtain photographic material Sample 301. In the above, the addition amount indicates the weight per $m^2$ of the photographic material. The amount of silver halide is converted to that of silver. In addition to the above composition were also added coating aids SU-1, SU-2 and SU-3, dispersing aid SU-4, thickener V-1, stabilizers ST-1 and ST-2, antifoggants AF-3, AF-4 and AF-5, and hardeners H-1 and H-2. Chemical structures of the compounds used in the sample are shown below.

Dye Y

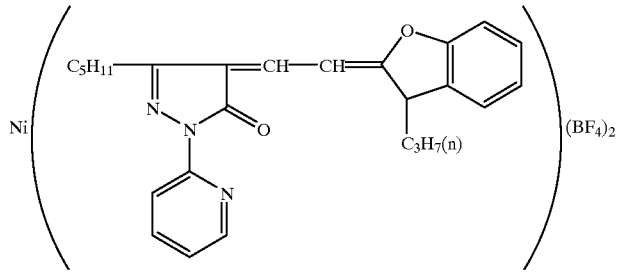

-continued
Dye M
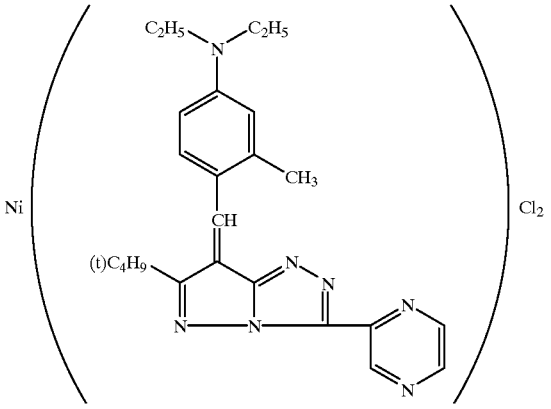
Dye C
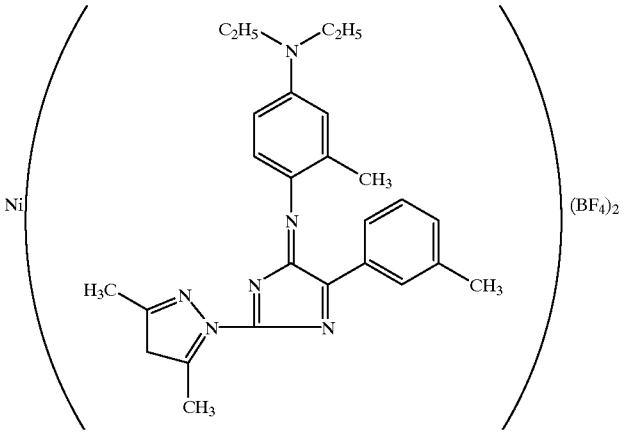
Yellow Dye 2
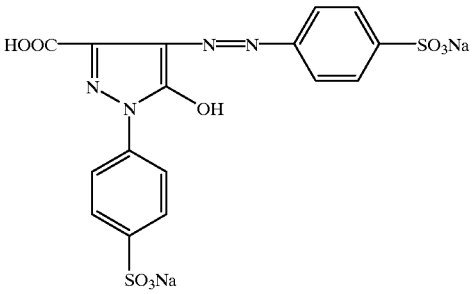
Y-1
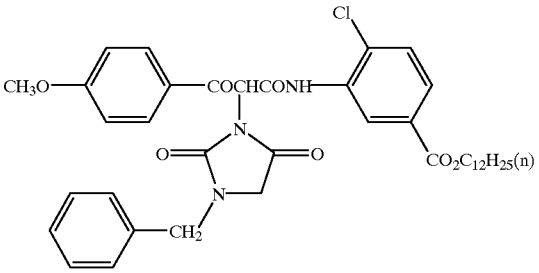

-continued
M-1
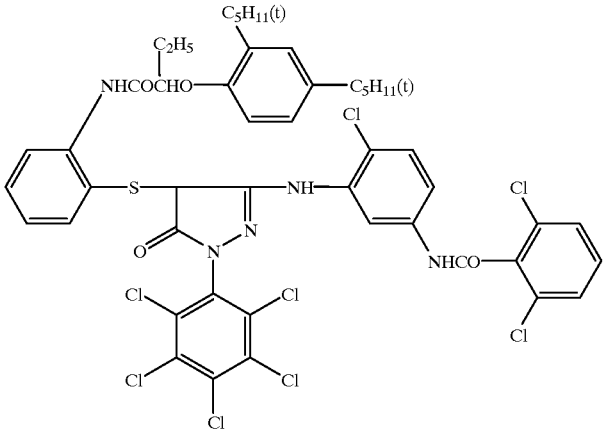
C-1
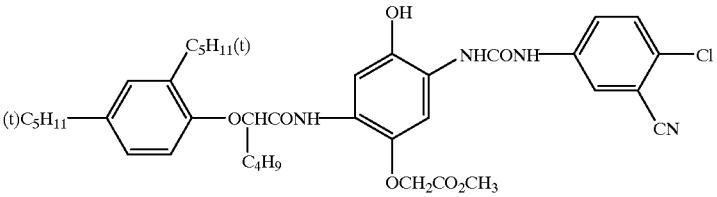
SD-1
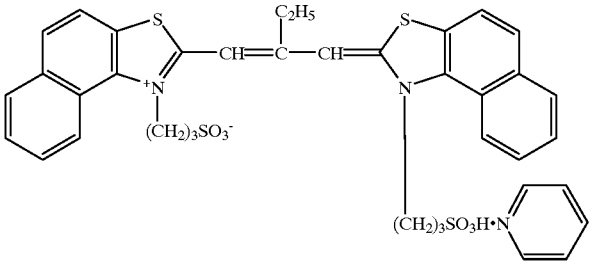
SD-2
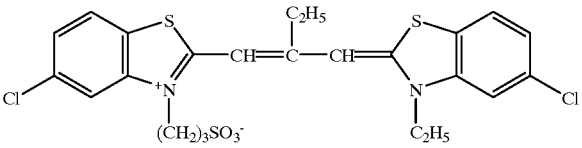
SD-3
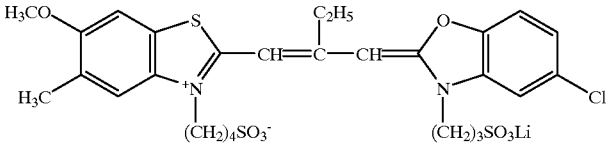
SD-4
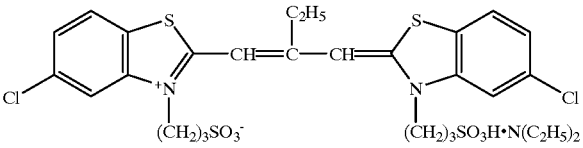
SD-5
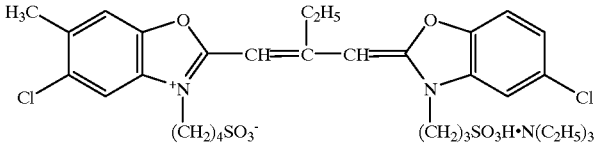

-continued
SD-6
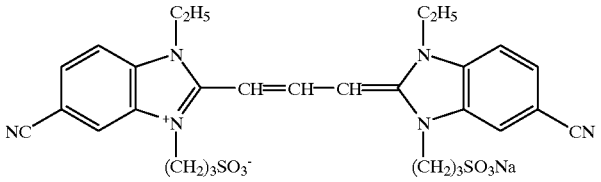
SD-7
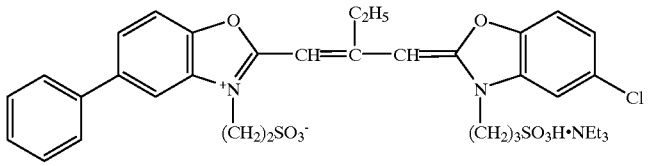
SD-8
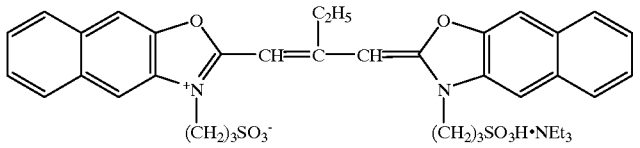
SD-9
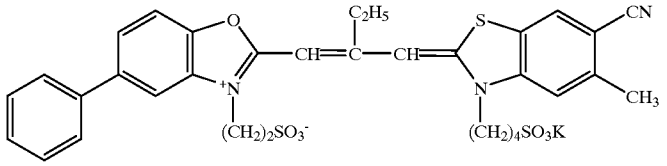
SD-10
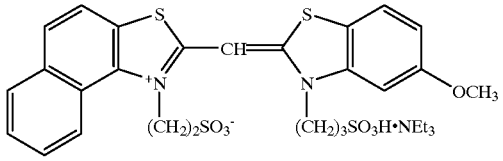
SD-11
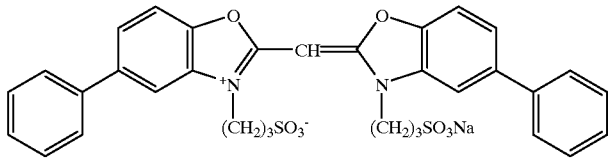
ST-1
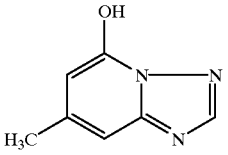
ST-2
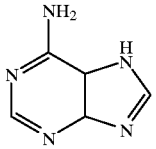

-continued
AF-1,2
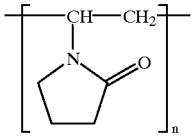
AF-1 Mw = 10,0000
AF-2 Mw = 1,100,000
n: Degree of polymerization
AF-3
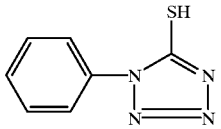
AF-4
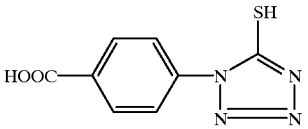
AF-5
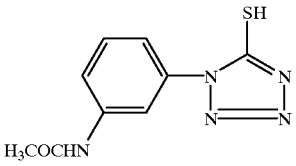
SU-1
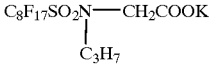
SU-2
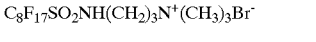
SU-3
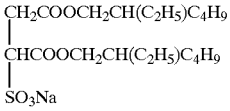
SU-4
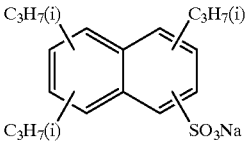
WAX-1
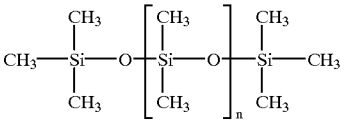
MW = 3,000
D-1
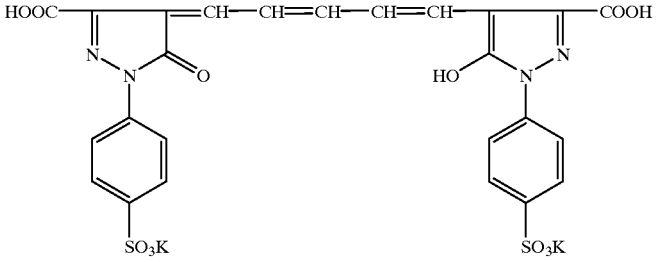

-continued

PM-1

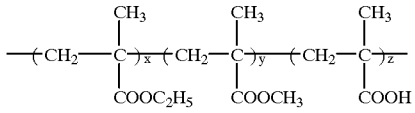

x:y:z = 3:3:4

PM-2

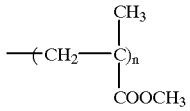

n: Degree of polymerization

OIL-1

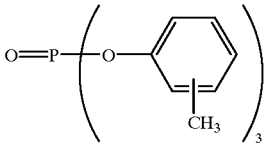

OIL-2

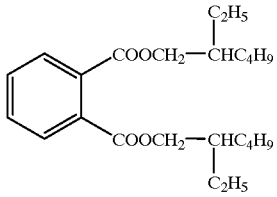

UV-1

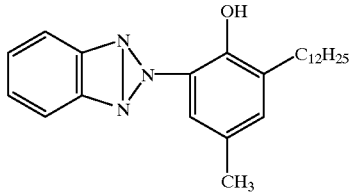

UV-2

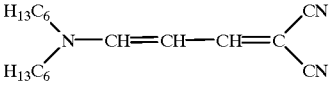

V-1

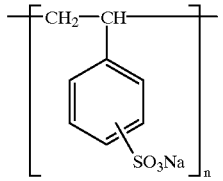

n: Degree of polymerization

H-1

H-2

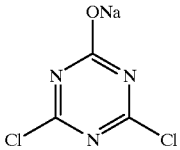

Sample 301 was exposed, subjected to the C-41 process and dried to obtain Sample 302. Using a color scanner, Q-scan (available from Konica Corp.), image information of Sample 302 was read and further inputted to a Macintosh Power Book 7500. As a result, clear color image information with superior sharpness was obtained. As can be seen from the results of Example 3, it was proved that using a monochromatic photographic material, color images. and color image information could be readily obtained.

Example 4

Spray Development

Photographic material Sample 301 prepared in Example 3 was previously heated to 45° C. and a developing solution 4 which was heated to 45° C., was sprayed on Sample 301 at a rate of 0.2 ml/cm$^2$ over a period of 40 sec. Then, a 3% acetic acid aqueous solution was further sprayed thereon as a stop treatment to obtain Sample 402. Using a color scanner, Q-scan (available from Konica Corp.), image information of Sample 402 was read and further inputted to Macintosh Power Book 7500. As a result, clear color image information with superior sharpness was obtained. The total time required for the spray development and stop treatment was 45 sec. and the spray development enabled high speed processing. As can be seen from the results of Example 4, it was proved that using a photographic material according to the invention, color images and color image information could readily and rapidly be obtained by using spray development.

Composition of developing solution 4

Water 800 ml
CD-4 18 g
Potassium carbonate 30 g
Sodium hydrogencarbonate 3 g
Potassium sulfite 3 g
Sodium bromide 1 g
Hydroxylamine sulfate 3 g
Diethylenetriaminepentaacetic acid 3 g Water was added to make 1,000 ml and the pH was adjusted to 10.8 with potassium hydroxide or sulfuric acid.

Example 5

Resources Recovery

The coating weight of silver of Samples 301 and 402 of Examples 3 and 4 was determined by X-ray analysis. It was confirmed that processed Sample 402 contained not less than 99 mol % of the silver content of Sample 301. Thus, it was proved that when spray development was applied to the silver halide photographic material according to this invention, substantially all of the silver resources were contained in the photographic material, leading to advantageous silver resources recovery.

Comparative Example 2

Using a color negative film JX-100 available from Konica Corp., portraits were taken and the Macbeth Color Chart was also photographed. This negative film was processed according to Example 4 to obtain Comparative Sample 2. When the image information of Comparative Sample 2 was read using a color scanner Q-scan (available from Konica Corp.), blue images being read with blue light were not completely read. As can be seen therefrom, it was shown that when a conventional color film was developed and silver resources were held within the film, only a part of the image information could be read.

Example 6

Sample 601 was prepared in a manner similar to Sample 301, except that coating solution 301 was coated on the side opposite the color filter layer. Sample 601 was further subjected to exposure and processing (C-41 process) to obtain Sample 602. This sample was evaluated in a manner similar to Example 3. As a result, it was proved that clear color images with superior sharpness were obtained.

What is claimed is:

1. A silver halide light sensitive photographic material comprising a transparent support having thereon a silver halide emulsion layer, and said photographic material further having a color filter layer comprising picture elements which are comprised of a colored resin and are randomly arranged.

2. The photographic material of claim 1, wherein said color filter layer further comprises a water miscible binder.

3. The photographic material of claim 1, wherein said colored resin contains a colorant of a metal complex compound.

4. The photographic material of claim 1, wherein said colored resin is comprised of the three primary colors.

5. The photographic material of claim 1, wherein said support is comprised of triacetyl cellulose, polyethylene terephthalate or polyethylene naphthalate.

6. The photographic material of claim 1, wherein said colored resin has a glass transition temperature of 40 to 100°C.

7. The photographic material of claim 6, wherein said picture elements are formed of colored resin particles, said resin particles comprising an interior portion and an exterior portion and the exterior portion exhibiting a glass transition temperature higher than the interior portion.

8. The photographic material of claim 1, having one side of the support said color filter layer and having on the other side of the support the silver halide emulsion layer.

9. The photographic material of claim 1, having one side of the support said color filter layer and the silver halide emulsion layer in this order from the support.

* * * * *